United States Patent [19]

Garay

[11] Patent Number: 4,494,120

[45] Date of Patent: Jan. 15, 1985

[54] TWO ELEMENT LOW PROFILE ANTENNA

[75] Inventor: Oscar M. Garay, North Lauderdale, Fla.

[73] Assignee: Motorola, Inc., Schaumburg, Ill.

[21] Appl. No.: 489,894

[22] Filed: Apr. 29, 1983

[51] Int. Cl.[3] ..... H01Q 1/48

[52] U.S. Cl. ..... 343/702; 343/834; 343/845

[58] Field of Search ..... 343/702, 705, 708, 741, 343/742, 824, 825, 826, 828, 829, 830, 834, 845, 846, 848, 866

[56] References Cited

U.S. PATENT DOCUMENTS

| | | | |
|---|---|---|---|
| 3,155,975 | 11/1964 | Chatelain | 343/785 |
| 3,184,746 | 5/1965 | Chatelain | 343/742 |
| 3,283,330 | 11/1966 | Chatelain | 343/785 |
| 3,366,963 | 1/1968 | Goff | 343/741 |
| 3,488,657 | 1/1970 | Pressel et al. | 343/708 |
| 3,573,831 | 4/1971 | Forbes | 343/705 |
| 3,623,161 | 11/1971 | Fujimoto et al. | 343/702 |
| 3,696,431 | 10/1972 | Holland | 343/713 |
| 3,808,600 | 4/1974 | Bourdier | 343/830 |
| 3,984,838 | 10/1976 | Voronoff | 343/845 |
| 4,070,676 | 1/1978 | Sanford | 343/700 MS |

OTHER PUBLICATIONS

Frink, Jr., Abstract No. 656,243, Antenna, published Dec. 20, 1949, 370 O.G. 757.

*Primary Examiner*—Eli Lieberman
*Assistant Examiner*—Michael C. Wimer
*Attorney, Agent, or Firm*—Joseph T. Downey; James W. Gillman; Edward M. Roney

[57] ABSTRACT

An antenna is provided which exhibits a low profile. The antenna includes a counterpoise of electrically conductive material and a passive element oriented substantially parallel thereto. The ends of the passive element are electrically coupled to the counterpoise surface. An active element of electrically conductive material includes a middle portion and first and second outer end portions. The middle portion is situated adjacent and spaced apart from the passive element by a predetermined distance and in a parallel relationship therewith. The first outer end portion of the active element is bent toward the grounded end of the passive element nearest thereto. The first outer end portion represents a feedpoint of the antenna with respect to the counterpoise. The remaining second outer end portion the active element is bent towards the remaining end of the passive element nearest thereto. The first and second outer portions by virtue of the bends which orient them close to the ends of the passive element result in coupling of substantial electromagnetic energy between the active element and a passive element. Substantial electromagnetic energy is radiated with both horizontal polarization and vertical polarization when the antenna is excited.

3 Claims, 3 Drawing Figures

TWO ELEMENT LOW PROFILE ANTENNA

BACKGROUND OF THE INVENTION

This invention relates to low profile antennas and, more particularly to low profile antennas capable of radiating electromagnetic energy exhibiting more than one polarization for use on portable data terminals and other transmitting and receiving radio apparatus which may be operated in a plurality of different spatial orientations and over a plurality of different surfaces including wood, metal, plastic and the human body.

DESCRIPTION OF THE PRIOR ART

In the past, many portable radio devices and associated equipment have employed vertical antennas for transmitting or receiving purposes. Unfortunately, such vertical antennas tend to significantly increase the overall dimensions of the portable radio device of which it is a part. These vertical antennas radiate and receive radio signals which are vertically polarized. This can result in signal degradation if the portable radio is frequently subjected to substantial changes of orientation, that is from vertical to horizontal orientation and in between. Moreover, signal degradation typically results if highly conductive surfaces are situated parallel to, and in close proximity to, such vertical antennas.

In an effort to reduce the overall height of vertical antennas, such antennas are often compressed into helical type vertical antennas. Unfortunately, although such helical antennas exhibit a reduced overall vertical dimension, they are not as efficient as their full size vertical counterparts. Moreover, such helical vertical antennas exhibit the same single direction polarization drawbacks as their full size vertical counterparts.

It is one object of the present invention to provide a low profile antenna which avoids the functional and aesthetic size problems associated with conventional antennas for portable radio devices.

Another object of the invention is to provide a low profile antenna which radiates electromagnetic energy with two polarizations so as to lessen the undesirable effect of changing the orientation of a portable radio device to which the antenna is attached.

These and other objects of the invention become apparent to those skilled in the art upon consideration of the following description of the invention.

BRIEF SUMMARY OF THE INVENTION

The present invention is directed to providing an antenna which exhibits a low profile and which is capable of radiating electromagnetic energy having two polarizations.

In accordance with one embodiment of the invention, a low profile antenna includes a counterpoise of electrically conductive material having a surface. The antenna further includes a passive element oriented substantially parallel to the counterpoise surface and situated at a predetermined first distance above the counterpoise. The passive element includes first and second opposed ends, each of which is electrically connected to the counterpoise. An active element is situated adjacent and spaced apart from the passive element and in a plane substantially parallel to the counterpoise surface. The active element is situated at a second predetermined distance above the counterpoise surface. The active element includes a middle portion and first and second end portions. Each of these portions of the active element exhibits a respective predetermined length. The middle portion is oriented substantially parallel to the passive element and is separated therefrom by a predetermined distance. The first end portion extends angularly away from one end of the middle portion toward a first locus adjacent to the first end of the passive element at which point is designated the antenna feedpoint. The antenna feedpoint is separated from the counterpoise surface. The second end portion extends angularly away from the remaining end of the middle portion toward a second locus adjacent to the second end of the passive element at which point the second end portion is electrically connected to the counterpoise surface.

The features of the invention believed to be novel are set forth with particularity in the appended claims. The invention itself, however both as to organization and method of operation together with further objects and advantages thereof, may best be understood by reference to the following description taken in conjunction with the accompanying drawings.

DESCRIPTION OF THE PREFERRED EMBODIMENT

Figure 1:
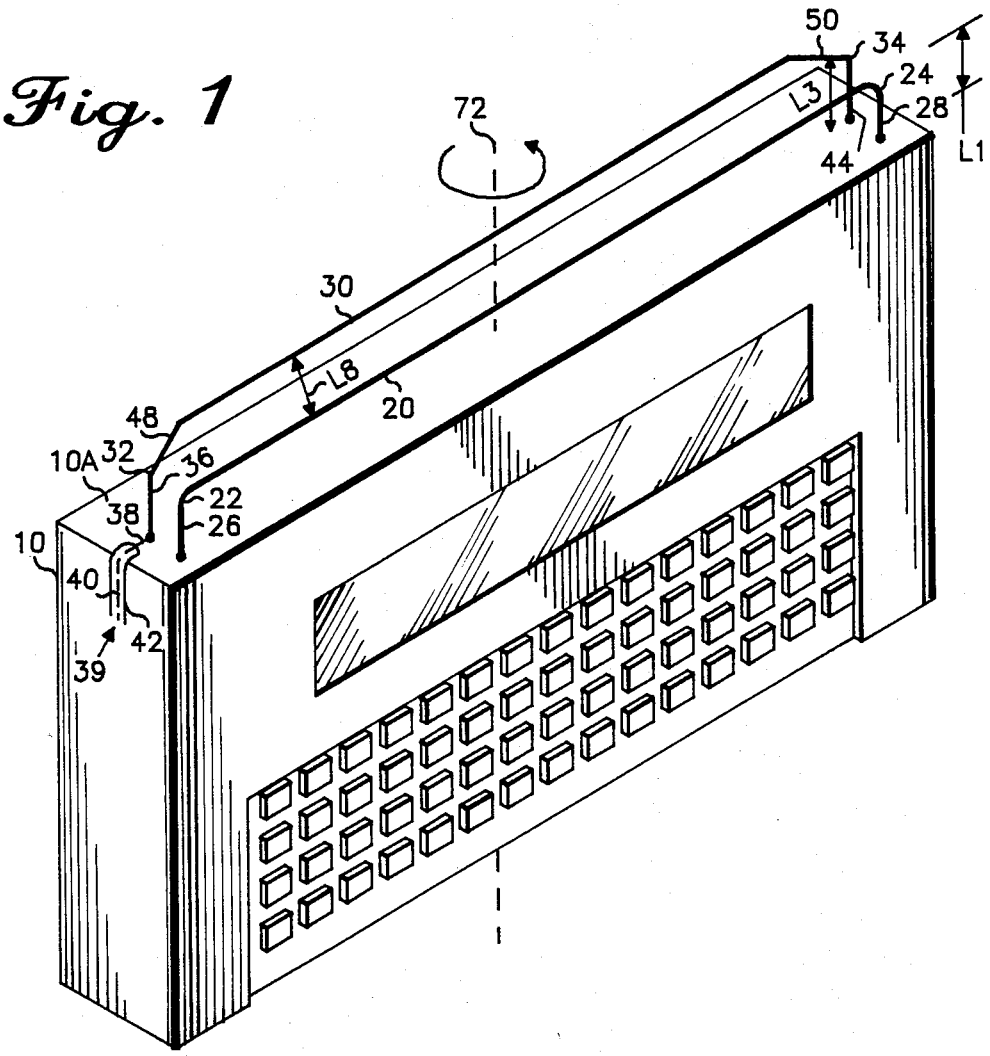
FIG. 1 is a perspective view of the antenna of the present invention.

FIG. 1 illustrates one embodiment of the low profile antenna of the present invention. The antenna of FIG. 1 is shown mounted on a largely metallic, rectangularly shaped structure 10 which includes a metallic surface 10A. The surfaces of structure 10, especially metallic surface 10A, act as a counterpoise for the antenna. Structure 10 represents a portable radio device or similar apparatus.

Figure 2:
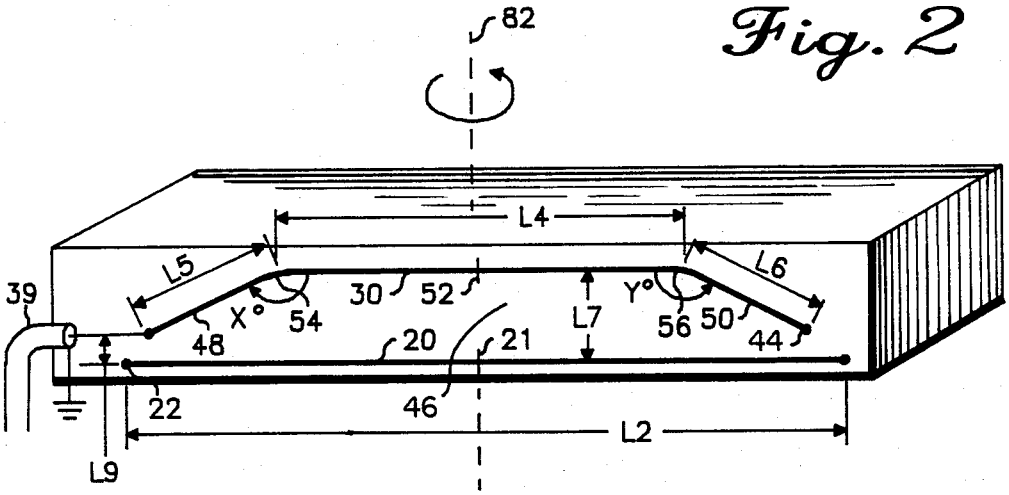
FIG. 2 is another perspective view of the antenna of the present invention.

A passive element 20 of electrically conductive material is situated a predetermined distance L1 above counterpoise surface 10A. Passive element 29 is oriented substantially parallel to counterpoise surface 10A and exhibits a length L2 as shown in FIG. 2. The length of passive element 20, L2, is approximately equal to one-half of the wavelength of the desired operating frequency for the antenna. Thus, by way of example wherein the desired antenna operating frequency is approximately 850 MHz, L2 is found to equal approximately 16 centimeters. It is appreciated by those skilled in the art that scaled up or scaled down versions of the present antenna will function at frequencies other than those given in the present example and that versions of the antenna operating at such other frequencies are intended to be within the scope of this invention.

Passive element 20 includes opposed ends 22 and 24 which are respectively electrically connected or shorted to counterpoise surface 10A by electrically conductive substantially vertical connecting members 26 and 28, respectively. Connecting members 26 and 28 are oriented substantially perpendicular counterpoise surface 10A.

An active element 30 of electrically conductive material is situated alongside passive element 20 as shown in FIG. 1 to achieve excitation of passive element 20 in a parasitic manner. More specifically, element 30 is situated adjacent and spaced apart from passive element 20 in a plane substantially parallel to counterpoise surface 10A. As shown in FIG. 1, active element 30 is situated a predetermined distance L3 above counterpoise surface 10A. Active element 30 includes ends 32 and 34. A connecting member 36 of electrically conductive material is coupled between end 32 and the feedpoint 38 of the antenna. Member 36 is oriented substantially vertical to counterpoise surface 10A. Feedpoint 38 is situated adjacent the point on counterpoise surface 10A where connecting member 26 is coupled to the counterpoise.

Feedpoint 38 is coupled to a 50 ohm coaxial cable 39 which includes a center conductor 40 and a shield 42. Center conductor 40 is coupled to connecting member 36 at feedpoint 38, or more specifically at the base thereof near the surface of counterpoise 10A. Center conductor 40 is insulated from counterpoise surface 10A. Shield 42 is electrically coupled to counterpoise surface 10A at feedpoint 38. Connecting member 36 is oriented substantially parallel to connecting member 26.

End 34 of active element 30 is electrically coupled to counterpoise surface 10A via an electrically conductive member 44. Connecting member 44 exhibits a length L3. Moreover, connecting member 44 is oriented substantially parallel to connecting member 28 and substantially perpendicular to counterpoise surface 10A. It is noted that L3 is typically somewhat smaller than, equal to or somewhat greater than L1 depending upon the size constraints for a particular antenna application. For example, in one embodiment of the invention L3 is equal to 1.1 centimeters.

Active element 30 includes a middle portion 46 and outer end portions 48 and 50 as shown in FIG. 1 and more clearly in FIG. 2. Middle portion 46 is oriented substantially parallel to passive element 20. Middle portion 46 includes a center 52 which is aligned with the center 21 of passive element 20, as seen in FIG. 2.

At the end 54 of middle portion 46 nearest feedpoint 38, active element 30 bends toward end 22 of passive element 20 at an angle of X degrees as shown in FIG. 2, wherein X=145° by way of example. At the remaining end 56 of middle portion 46, active element 30 bends toward the remaining end of passive element 20 at an angle of Y degrees as shown in FIG. 2, wherein Y=145° by way of example. It is understood that the angles X and Y may have values other than 145° according to the particular physical implementation of the antenna. In this embodiment of the invention wherein the desired operating frequency of the antenna is approximately 851 Mhz, middle portion 46 exhibits a length L4 approximately equal to 7.6 centimeters. Outer portions 48 and 50 exhibit length of L5 and L6, respectively. In this embodiment of the invention, L5 and L6 are approximately equal to 4.2 centimeters. The overall length of active element 30, namely the sum of L4, L5, and L6, is approximately equal to one-half wavelength at the desired antenna operating frequency. The distance between passive element 20 and the middle portion 46 of active element 30 is equal to L7 which in this embodiment of the invention is approximately equal to 2.4 centimeters.

Figure 3:
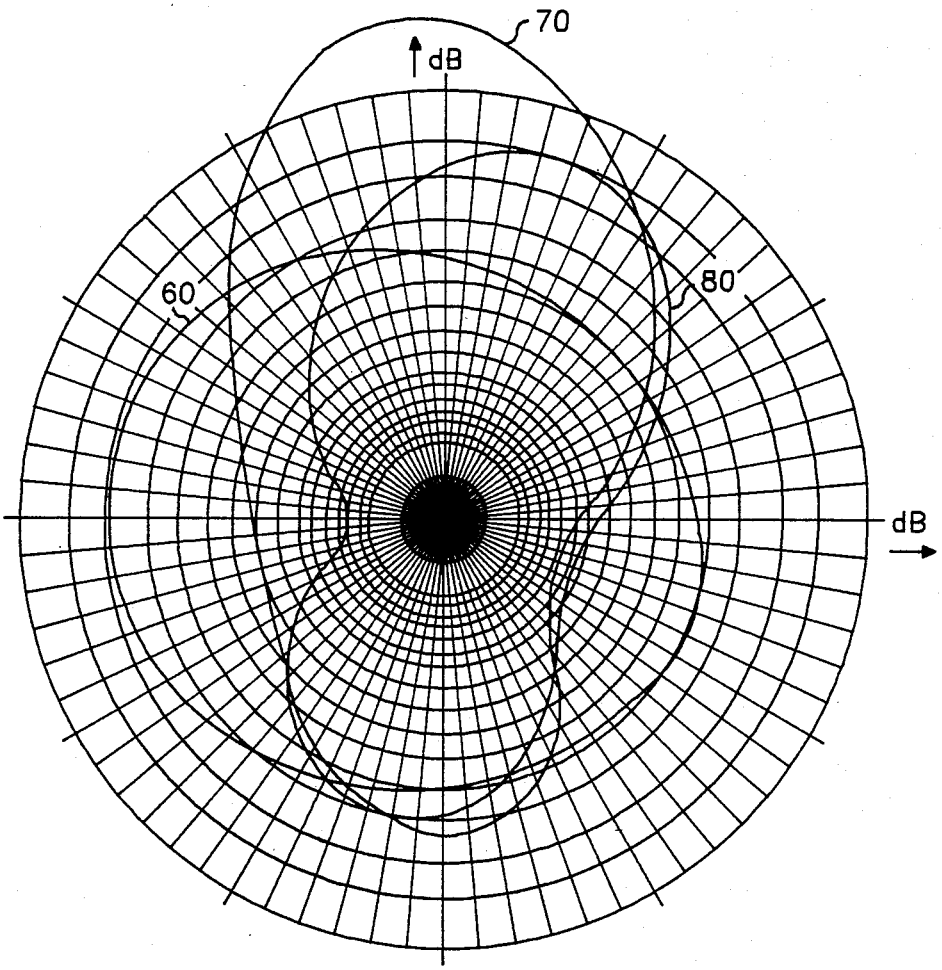
FIG. 3 is a graph which shows the radiation pattern of the antenna of the present invention for different orientations of the antenna as compared with one type of vertical dipole antenna.

FIG. 3 illustrates the radiation pattern as perceived by a vertically polarized sensing antenna situated adjacent the subject antenna for different orientations of the subject antenna. The radiation pattern on the Motorola 800 MHz sleeve dipole antenna, Model No. NAF4000A is shown in FIG. 3 as pattern 60. Pattern 60 is conveniently employed as a reference. The sensing antenna is situated on a plane parallel to the axis 72 of the antenna shown in FIG. 1 and horizontally aligned with the antenna. The sensing antenna is polarized in the direction of axis 72. The radiation pattern 70 shown in FIG. 3 is achieved when the antenna of the invention is oriented as shown in FIG. 1 and rotated in the direction of the arrow about axis 72. The radiation pattern 80 is generated when the subject antenna oriented as shown in FIG. 2 is rotated about axis 82. The sensing antenna employed to observe radiation pattern 80 is situated in a plane parallel to axis 82 and horizontally aligned with the subject antenna. The sensing antenna is polarized in the direction of axis 82. From the radiation patterns of FIG. 3, it is seen that the antenna of the invention exhibits substantial horizontal polarization as well as substantial vertical polarization. Stated alternatively, the antenna of the invention as observed by the sensing antenna oriented as discussed above, exhibits substantial vertical polarization whether oriented in the manner shown in FIG. 1 or oriented in the manner shown in FIG. 2. Those skilled in the art appreciate the advantages of an antenna which exhibits substantial vertical polarization when positioned in a number of different orientations.

When the antenna of the invention is excited, a first field is created between active element 30 and counterpoise surface 10A. A second field is created between passive element 20 and counterpoise surface 10A. The first and second fields each exhibit the same polarization, but these fields have opposite directions of radiation. At the same time, the antenna generates a second polarization caused by interaction between active element 30 and passive element 20. Thus, since two polarizations are generated, if the subject antenna comes in close proximity to the human body, advantageously only one of the two polarizations is substantially diminished in terms of amplitude of the radiated signal. The other polarization remains substantially undiminished in amplitude despite such close proximity of the antenna to the body.

The present antenna exhibits a desirable impedance bandwidth between approximately 800–880 MHz. That is, the approximate 50 ohm input impedance of the antenna remans relatively constant between 800–880 MHz. Moreover, the antenna is found to be highly efficient.

The foregoing describes a low profile antenna which radiates or receives substantial amounts of electromagnetic energy of one polarization despite being oriented in a plurality of different orientations. The subject antenna avoids the functional and aesthetic size problems associted with conventional antennas for portable radio devices.

While only certain preferred features of the invention have been shown by way of illustration, many modifications and changes will occur to those skilled in the art. It is, therefore, to be understood that the present claims are intended to cover all such modifications and changes as fall within the true spirit of the invention.

What is claimed is:

1. A low profile antenna comprising:

a counterpoise of electrically conductive material having a surface;

a passive element oriented substantially parallel to said counterpoise surface and situated at a predetermined first distance above said counterpoise surface, said passive element having first and second opposed ends each of which is electrically connected to said counterpoise surface; and an active element situated adjacent and spaced apart from said passive element in a plane substantially parallel to said counterpoise surface and at a second predetermined distance above said counterpoise surface and including a middle portion and first and second end portions, each of said portions exhibiting a respective predetermined length, said middle portion being oriented substantially parallel to said passive element;

said first end portion extending angularly away from one end of said middle portion toward a first locus adjacent to the first end of said passive element at which point is designated the antenna feed-point, said feedpoint being separated from said counterpoise surface, said second end portion extending from the remaining end of said middle portion toward a second locus adjacent to the second end of said passive element at which point said second end portion is electrically connected to said counterpoise surface.

2. The antenna of claim 1 wherein said passive element exhibits a length of approximately one half wavelength at the selected operating frequency of the antenna.

3. The antenna of claim 2 wherein said active element exhibits an overall length of approximately one half wavelength at the selected operating frequency of the antenna.

* * * * *